US009353550B1

(12) United States Patent
Smith, III

(10) Patent No.: US 9,353,550 B1
(45) Date of Patent: May 31, 2016

(54) LOCK ENGAGEMENT STATUS INDICATOR SYSTEM

(71) Applicant: Shelby G. Smith, III, Fort Lauderdale, FL (US)

(72) Inventor: Shelby G. Smith, III, Fort Lauderdale, FL (US)

( * ) Notice: Subject to any disclaimer, the term of this patent is extended or adjusted under 35 U.S.C. 154(b) by 217 days.

(21) Appl. No.: 14/026,798

(22) Filed: Sep. 13, 2013

Related U.S. Application Data

(60) Provisional application No. 61/700,877, filed on Sep. 13, 2012.

(51) Int. Cl.

| | |
|---|---|
| ***E05B 41/00*** | (2006.01) |
| ***E05B 39/00*** | (2006.01) |
| ***E05B 45/12*** | (2006.01) |
| *E05B 47/00* | (2006.01) |

(52) U.S. Cl.
CPC ..... *E05B 41/00* (2013.01); *E05B 39/00* (2013.01); *E05B 45/12* (2013.01); *E05B 2047/0067* (2013.01); *E05B 2047/0069* (2013.01)

(58) Field of Classification Search
CPC ..... E05B 41/00; E05B 39/00; E05B 45/12; E05B 2047/0067; E05B 2047/0069
See application file for complete search history.

(56) References Cited

U.S. PATENT DOCUMENTS

| | | | | |
|---|---|---|---|---|
| 4,248,463 | A * | 2/1981 | Hand | 292/340 |
| 6,016,677 | A * | 1/2000 | Clark | 70/416 |
| 6,078,256 | A * | 6/2000 | Gottlieb | 340/542 |
| 6,441,735 | B1 * | 8/2002 | Marko et al. | 340/542 |
| 6,912,429 | B1 * | 6/2005 | Bilger | 700/19 |
| 6,950,033 | B1 * | 9/2005 | Guyre | 340/687 |
| 2005/0160325 | A1 * | 7/2005 | Ogino et al. | 714/47 |
| 2010/0313612 | A1 * | 12/2010 | Eichenstein et al. | 70/124 |
| 2013/0127260 | A1 * | 5/2013 | Webb et al. | 307/112 |
| 2013/0145802 | A1 * | 6/2013 | Eichenstein | 70/432 |

* cited by examiner

*Primary Examiner* — Andrew Bee
(74) *Attorney, Agent, or Firm* — Allen D. Hertz, P.A.; Allen D. Hertz

(57) ABSTRACT

A door lock engagement status indicator system comprising a position indicating sensor installed adjacent to a striker box, wherein the position indicating sensor toggles between a first state identifying when a door lock throw bolt is placed in an extended or locked position and a second state identifying when the door lock throw bolt is placed in a retracted or unlocked position. A local lock engagement status monitoring apparatus monitors the sensor and displays the status of the indicating sensor, representative of the monitored lock status. Each local monitoring apparatus communicates with a master monitoring apparatus, wherein the master monitoring apparatus displays a complete summary of all of the associated local monitoring apparatus. The displayed status can utilize green and/or red lights providing a simple and clear monitoring system.

23 Claims, 6 Drawing Sheets

LOCK ENGAGEMENT STATUS INDICATOR SYSTEM

CROSS-REFERENCE TO RELATED APPLICATION

This Non-Provisional Utility application claims the benefit of U.S. Provisional Patent Application Ser. No. 61/700,877, filed on Sep. 13, 2012, which is incorporated herein in its entirety.

FIELD OF THE INVENTION

The present invention relates to a door lock security system, and more particularly, a door lock engagement indicator system that quickly informs an individual of a status of each door lock of a series of door locks of a structure.

BACKGROUND OF THE INVENTION

Security systems utilize components to identify when a door is placed in a closed position. The components are commonly a magnetic sensor or reed switch, which is attached to a fixed structure adjacent to the door (such as a doorframe, a doorjamb, a door lintel or header, an adjacent portion of a wall, and the like) in combination with a magnet, which is attached to a door. One drawback of this solution is that the door can be placed in a closed position, while remaining unlocked.

One method of ensuring that the doors of a structure are locked would be to manually check all of the doors individually. This process is time consuming and introduces a potential for human error.

An automated solution is a Nexia Home System, previously offered for sale as a Schlage home door lock or deadbolt operation system offered by Ingersoll Rand. This solution utilizes a custom, electronically operated door lock actuator to operate and identify a status of the door lock. The system is offered in each of a standard door lock and a deadbolt configuration. This solution requires selection and installation of the specific, expensive devices and cannot be retrofit to existing door lock equipment. The solution offers a very limited number of lock styles for the end user.

There is currently no other similar device that confirms that a door is secured properly with a dead bolt lock and is as easily installed to a typical door or retrofitted for integration with an existing door.

Accordingly, there remains a need in the art for a door lock monitoring system to identify and easily inform an individual of a status of a door lock of one or more doors of the structure.

SUMMARY OF THE INVENTION

The present invention overcomes the deficiencies of the known art and the problems that remain unsolved by providing an apparatus and method for automating an inspection method for determining a status of the lock for each of the doors of a structure.

In accordance with one embodiment of the present invention, the invention consists of a door lock engagement status indicator system comprising:

a striker box comprising a throw bolt receptacle for receiving and engaging a throw bolt when the throw bolt is extended into a locked position;

a sensor affixed at a location wherein the sensor detects when the throw bolt is extended into a position within the throw bolt receptacle; and a local lock engagement status monitoring apparatus comprising:

a local monitoring apparatus housing, a circuit in signal communication with the sensor, the circuit contained within an interior of the local monitoring apparatus housing, electrical power provided to the circuit, and an indicator to convey a status of at least one of:

when the throw bolt is extended into a position within the throw bolt receptacle, and when the throw bolt is retracted into a position clear of the throw bolt receptacle wherein the indicator is provided in a manner that conveys the status of the throw bold by an individual.

In a second aspect, the sensor is a push switch.

In another aspect, the sensor further comprising a switch plunger, wherein the sensor is carried by a distal end of the throw bolt receptacle and oriented with a plunging axis of the switch plunger being substantially parallel to a direction of motion of the throw bolt.

In yet another aspect, the indictor is an illuminating element, wherein the illuminating element can be a Light Emitting Diode (LED), an incandescent bulb, an electroluminescent panel, and the like.

In yet another aspect, the indictor is an audible generating element.

In yet another aspect, the illuminating element emits a light when the throw bolt is extended into a position within the throw bolt receptacle.

In yet another aspect, the illuminating element emits a green light when the throw bolt is extended into a position within the throw bolt receptacle.

In yet another aspect, the illuminating element emits a light when the throw bolt is retracted into a position clear of the throw bolt receptacle.

In yet another aspect, the illuminating element emits a red light when the throw bolt is retracted into a position clear of the throw bolt receptacle.

In yet another aspect, the illuminating element emits a flashing light when the throw bolt is retracted into a position clear of the throw bolt receptacle.

In yet another aspect, the local lock engagement status monitoring apparatus further comprises a local communication element integrated into the local circuit, wherein the local communication element comprises at least one of a local transmitter and a local transceiver.

In yet another aspect, the lock engagement status identification system further comprises:

a master lock engagement status monitoring apparatus comprising:

a master status monitoring apparatus housing, a master circuit, the master circuit contained within an interior of the master status monitoring apparatus housing, a master microprocessor integrated into the master circuit wherein the master microprocessor operates in accordance with a master set of instructions, a master communication element integrated into the master circuit, wherein the master communication element comprises at least one of a master receiver and a master transceiver, electrical power provided to the master circuit, and at least one master indicator, wherein each of the at least one indicator is associated with a respective one of the at least one local lock engagement status monitoring apparatus, wherein the at least one master indicator replicates a conveyance of the status conveyed by the one of the at least one local lock engagement status monitoring apparatus.

In yet another aspect, the lock engagement status identification system further comprises a communication interface for communicating with at least one Internet connected device.

In yet another aspect, the at least one Internet connected device can include at least one of:

an Internet, an Internet connected device, a smartphone, and a portable computing tablet; and indirectly:

a personal data assistant (PDA), and a pager.

In yet another aspect, the lock engagement status identification system further comprises a communication interface for communicating with at least one wireless device.

In yet another aspect, the wireless device can include at least one of:

an Internet, an Internet connected device, a smartphone, a portable computing tablet, a personal data assistant (PDA), and a pager.

In yet another aspect, signal communication between the local lock engagement status monitoring apparatus and the master lock engagement status monitoring apparatus can be accomplished using wired or wireless technology.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
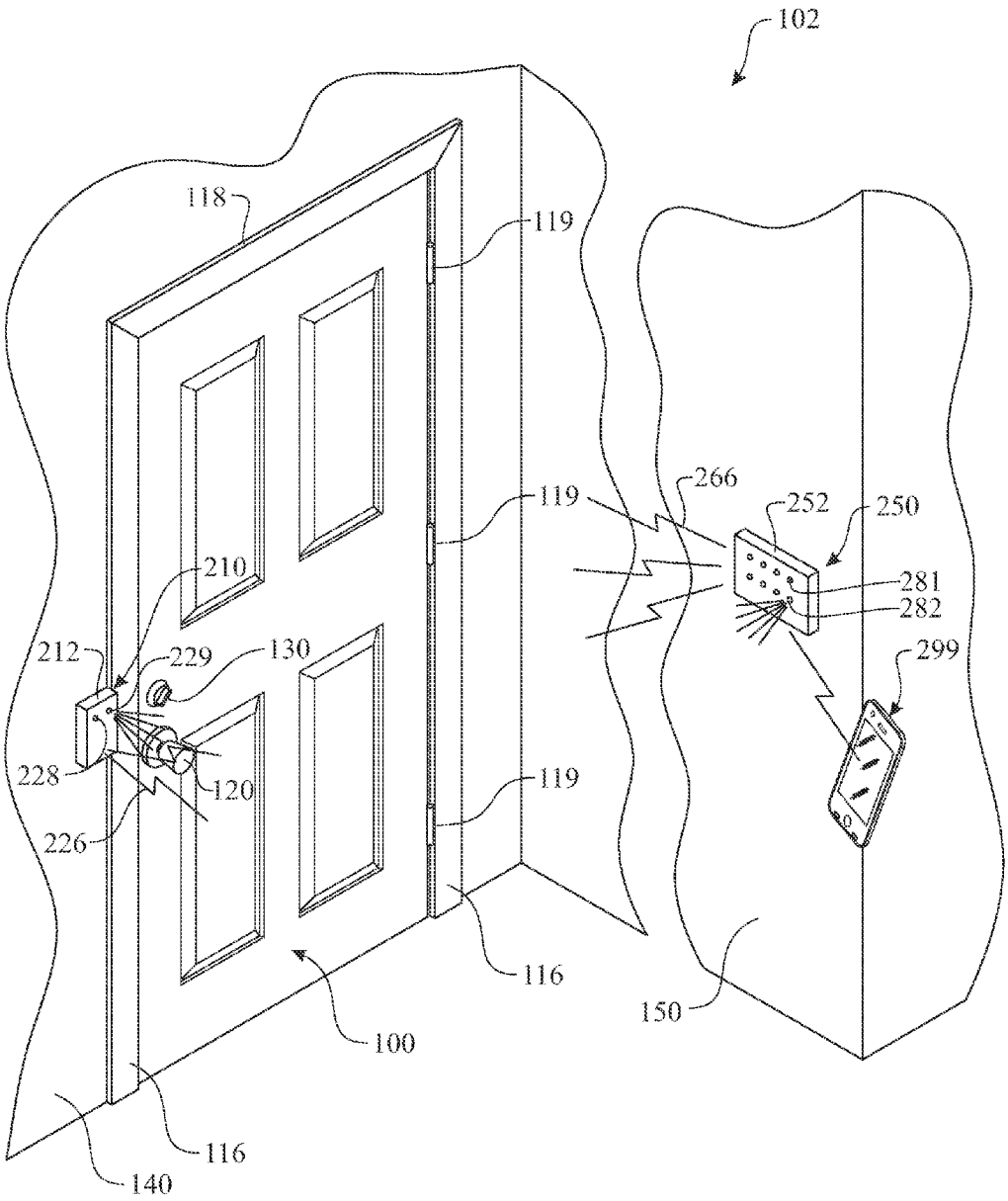
FIG. 1 presents a perspective view of an exemplary door lock engagement status indicator system illustrated in use.
Figure 2:
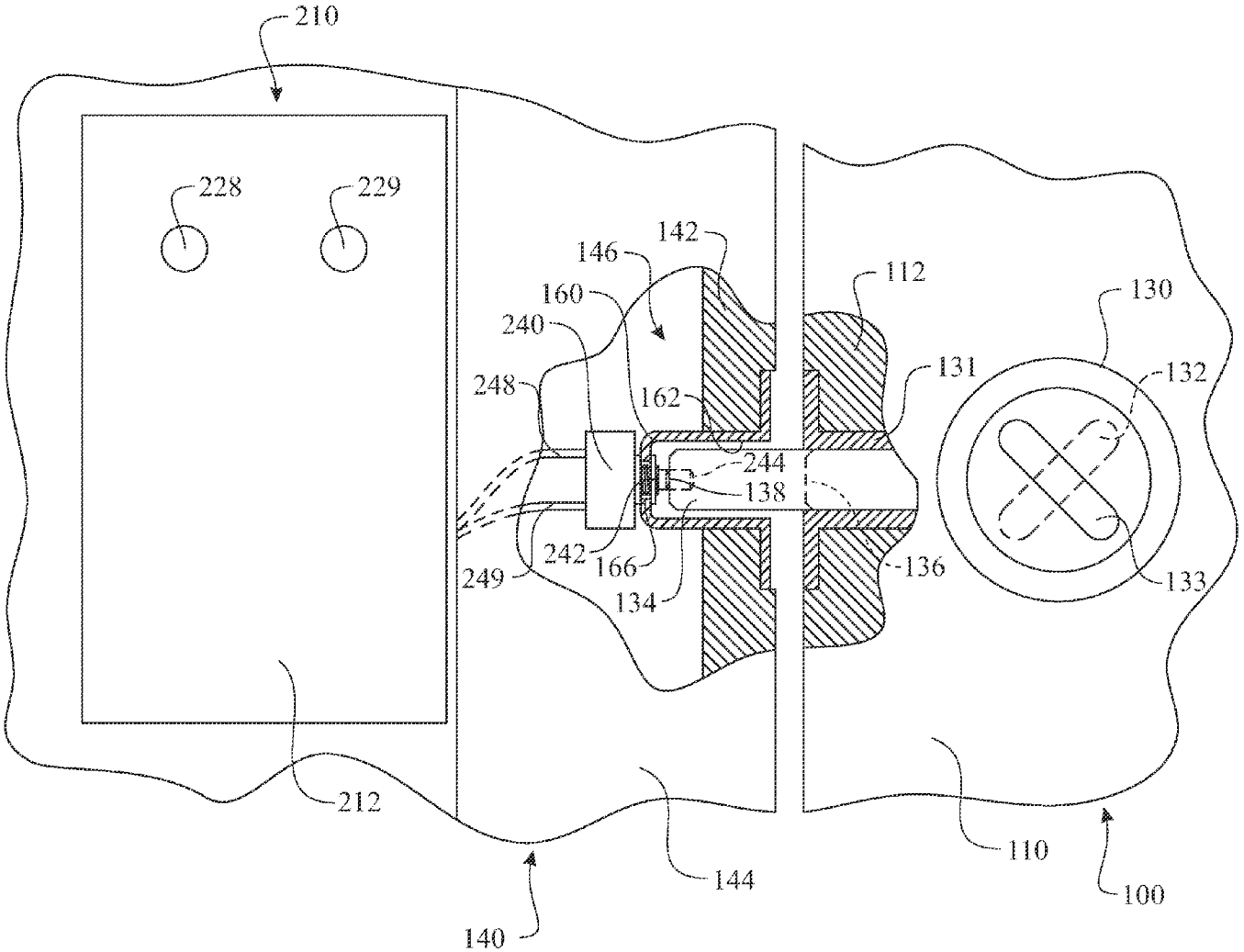
FIG. 2 presents a partial cutaway elevation view of a dead bolt status sensing configuration used in conjunction with the door lock engagement status indicator system introduced in FIG. 1.

Detailed embodiments of the present invention are disclosed herein. It will be understood that the disclosed embodiments are merely exemplary of the invention that may be embodied in various and alternative forms. The figures are not necessarily to scale, and some features may be exaggerated or minimized to show details of particular embodiments, features, or elements. Specific structural and functional details, dimensions, or shapes disclosed herein are not limiting but serve as a basis for the claims and for teaching a person of ordinary skill in the art the described and claimed features of embodiments of the present invention. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
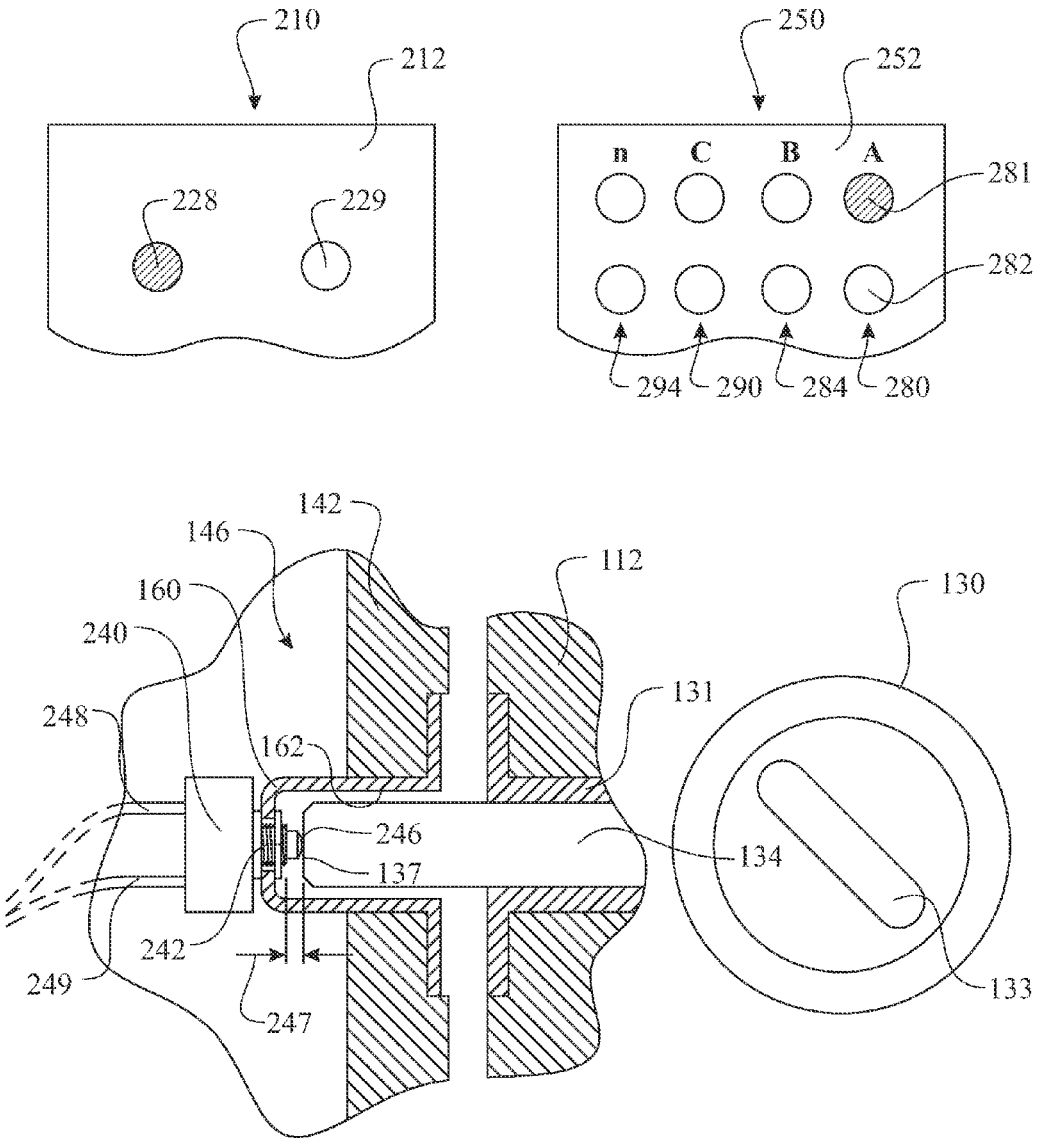
FIG. 4 presents a partial cutaway elevation view of the dead bolt status sensing configuration introduced in FIG. 2, wherein the dead bolt is shown in a locked position and the local and master status monitoring apparatus are shown displaying the associated locked indictors.
Figure 5:
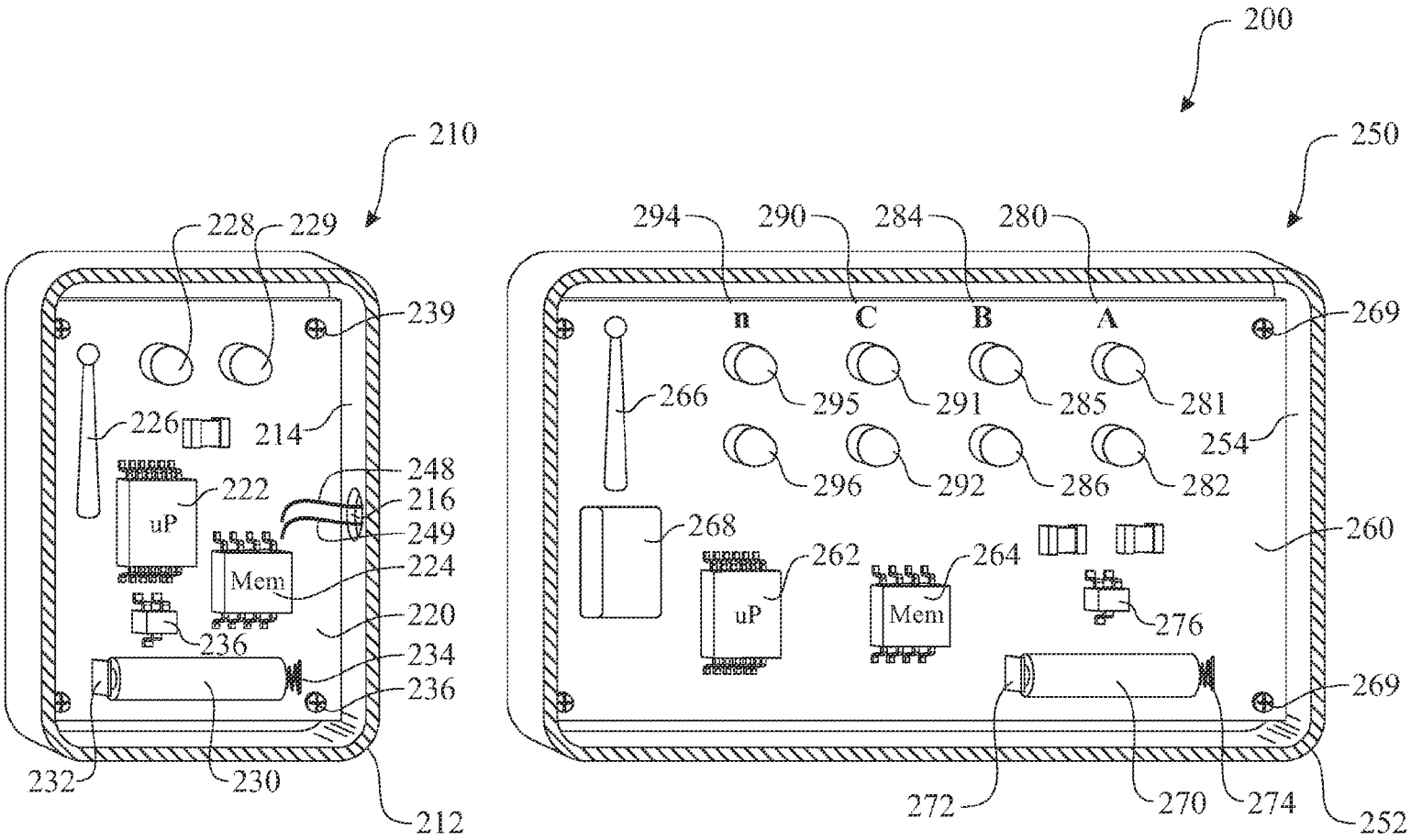
FIG. 5 presents a sectioned view of the local and master status monitoring apparatus detailing exemplary functional components integrated therein.
Figure 6:
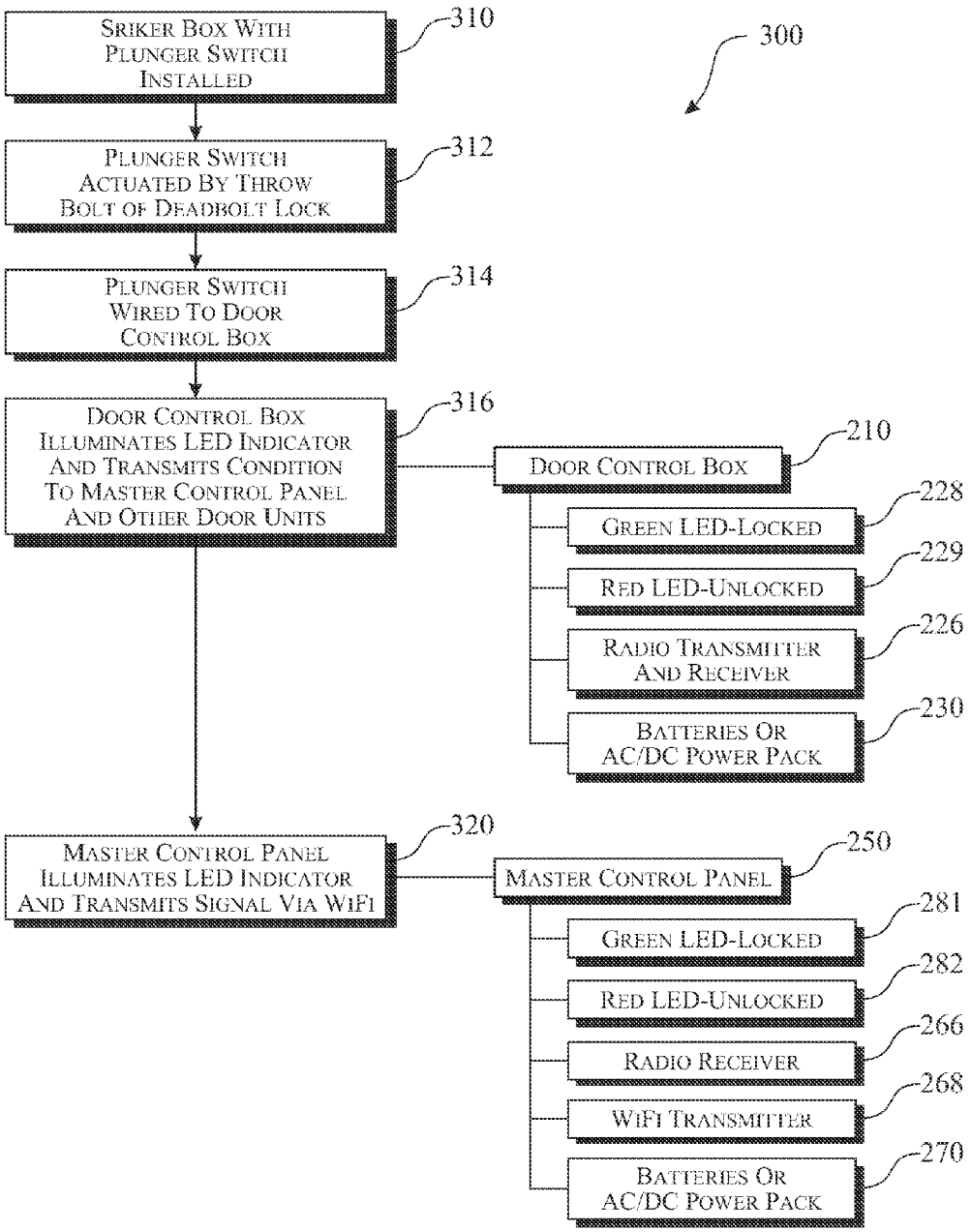
FIG. 6 presents an exemplary schematic diagram presenting a general installation and operation flow diagram of the door lock engagement status indicator system.

An exemplary lock engagement status identification system 200 is detailed in a series of illustrations presented in FIGS. 1 through 5, with an exemplary operational flow diagram being presented in FIG. 6.

A structure 102 normally includes a series of egresses wherein each egress is provided passage through and sealed by an installed door assembly 100. Each door 100 commonly includes a door latch operated by a doorknob 120. Each door commonly includes a locking system, represented in FIG. 1 by a door lock thumb turn 130 to secure the structure 102 from undesired access by others. To ensure that the structure 102 is properly secured, each door assembly 100 must be manually inspected to ensure that the door assembly 100 is locked. This process is time consuming and inherently introduces a potential for human error. A lock engagement status identification system 200 can be installed in the structure 102 to collectively monitor and convey a status or condition of each locking system for each respective door assembly 100.

For reference, the structure 102 includes a series of walls, including at least one first wall 140, which is representative of any wall comprising an egress and respective door assembly 100 and at least one second wall 150, which is representative of any interior or exterior wall of the structure 102. The door assembly 100 can be any suitable door incorporating a sliding locking element, such as a door lock throw bolt 134 shown in FIGS. 2 through 4. The door lock throw bolt 134 is commonly provided in a form factor referred to as a deadbolt. The door assembly 100 can be a hollow door, a solid door, a sectioned door, and the like. The hollow door includes a door veneer 110 attached to a door structure frame 112. The hollow doors can be fabricated of wood, metal, composite materials, plastics, and the like, and any combination thereof. Solid doors are typically fabricated of wood, but can be fabricated of any suitable materials known by those skilled in the art. Although the exemplary application is presented for a hinged door 100, it is understood that the system can be employed to monitor any closure for any opening, wherein the closure that is secured using a sliding or rotating locking element, which extends a portion of the locking element into a receptacle. This can include a roll up door (such as a garage door, a bay door, and the like), a window, and the like.

Additionally, the walls 140, 150, are fabricated using any suitable and known structure fabrication process respective to the size, location, style, shape, engineering, and the like of the building. The preferred wall fabrication would include a hollow wall interior 146. The wall would be fabricated having a series of spatially arranged wall studs 142 extending between a header (not shown, but well known in the art) and a footer (not shown, but well known in the art). The open framework is covered on each side using any suitable material, generally referred to as a wall panel 144. The wall panel 144 can be drywall, plasterboard, paneling, and the like.

In the exemplary embodiment, the door assembly 100 is pivotally assembled to a doorway frame by a plurality of door hinges 119. The exemplary doorway frame includes a pair of vertically oriented doorjambs 116 and a doorframe header 118 extending between upper ends of the pair of doorjambs 116. The doorway frame defined by the pair of doorjambs 116 and the doorframe header 118 is shaped to parallel and outline a peripheral edge of the door assembly 100. The door hinges 119 having one hinged side attached to a hinged side of the door assembly 100 and a second hinged side attached to a respective doorjamb 116, enabling a pivotal motion for the door assembly 100.

The door assembly 100 is secured in a closed orientation by a locking system. The locking system is best shown in the illustrations presented in FIGS. 2 through 4. The locking system employs a door lock thumb turn 130 to toggle a door lock throw bolt 134 between a retracted door lock position 136 and a extended door lock position 138. The user would rotate a grip portion of the door lock thumb turn 130 between a unlocked thumb turn 132 and a locked thumb turn 133, which, through any commonly known mechanical mechanism, toggles the door lock throw bolt 134 between a retracted door lock position 136 and a extended door lock position 138, respectively. The door lock throw bolt 134 is slideably guided through a channel within a deadbolt frame and guide plate 131. The deadbolt frame and guide plate 131 is inserted into a cavity machined into an edge of the door assembly 100.

A striker box 160 is inserted into a cavity (or aperture) formed through the wall stud 142 of the first wall 140. The striker box 160 is designed to include a throw bolt receptacle 162. The throw bolt receptacle 162 is sized and shaped to receive the door lock throw bolt 134 when the door lock throw bolt 134 is toggled into the extended door lock position 138 and located to be clear of the door lock throw bolt 134 when the door lock throw bolt 134 is toggled into the retracted door lock position 136. The striker box 160 preferably includes a striker box mounting flange 164 that is inserted into a shallow cavity extending inward from an exposed surface of the doorjamb 116 or the wall stud 142. The striker box 160 can be secured within the cavity by inserting a plurality of screwed through the striker box mounting flange 164 into the doorjamb 116 or the wall stud 142. The striker box 160 is sized, shaped, and located to receive the door lock throw bolt 134 when transitioning from a retracted door lock position 136 to an extended door lock position 138.

The lock engagement status identification system 200 includes a local lock engagement status monitoring apparatus 210, a master lock engagement status monitoring apparatus 250, and a push switch 240. The push switch 240 monitors the position of the door lock throw bolt 134 and provides a respective signal to the local lock engagement status monitoring apparatus 210. The local lock engagement status monitoring apparatus 210 conveys the status of the door lock throw bolt 134 to the master lock engagement status monitoring apparatus 250. Details of the local lock engagement status monitoring apparatus 210 and master lock engagement status monitoring apparatus 250 are provided below. The push switch 240 is preferably selected from any suitable available off-the-shelf components.

The push switch 240 is installed in a manner to identify when the door lock throw bolt 134 is placed in a retracted door lock position 136 or an extended door lock position 138. The preferred configuration assembles the push switch 240 to an exterior, inset end of the striker box 160. A plunger switch mounting aperture 166 can be drilled through the exterior, inset end of the striker box 160. The operational end of the push switch 240 is inserted through the plunger switch mounting aperture 166. The shaft of the operational end of the push switch 240 is commonly threaded. In this configuration, the shaft would be inserted through the plunger switch mounting aperture 166 and the striker box 160 would be secured in position by threading and tightening a nut on an exposed end of the shaft, sandwiching a section of the striker box 160 between the nut and the striker box 160.

Figure 3:
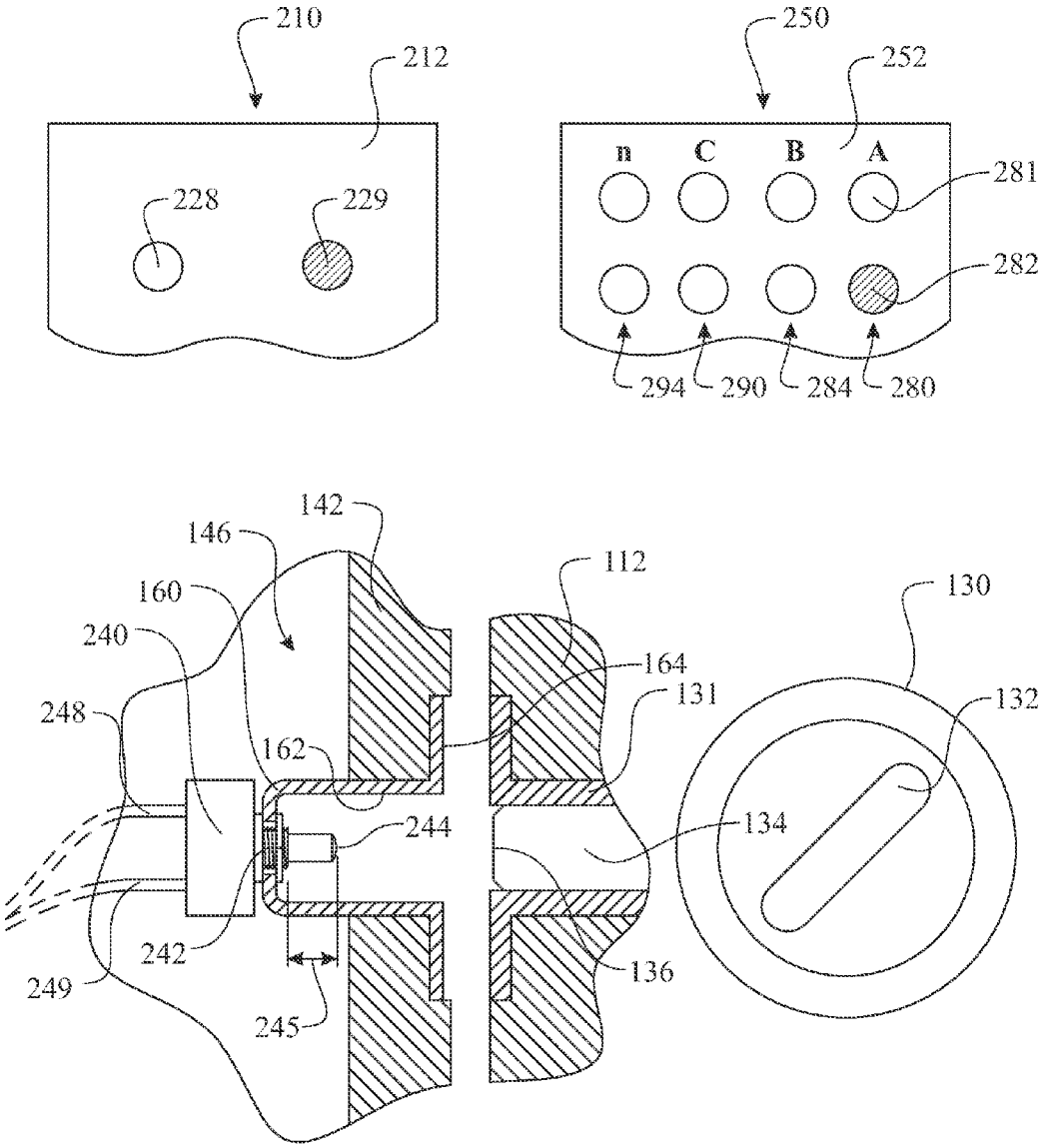
FIG. 3 presents a partial cutaway elevation view of the dead bolt status sensing configuration introduced in FIG. 2, wherein the dead bolt is shown in an unlocked position and local and master status monitoring apparatus are shown displaying the associated unlocked indictors.

Functionally, the push switch 240 is preferably assembled to the striker box 160 orienting the extended plunger condition 244 substantially parallel with a longitudinal axis of the door lock throw bolt 134. The push switch 240 is selected wherein the switch plunger 242 has a natural, relaxed state as an extended plunger 244, wherein the distance between the distal end of the switch plunger 242 and a base of the switch plunger 242 is referenced as a extended plunger dimension 245. The switch plunger 242 remains in an extended plunger condition 244 when the door lock throw bolt 134 is placed into a retracted door lock position 136, as illustrated in FIG. 3. The switch plunger 242 is compressed into a retracted plunger condition 246 when subjected to an axial force, more particularly when the door lock throw bolt 134 is placed into an extended door lock position 138, as illustrated in FIG. 4. The plunger is compressed into a retracted plunger condition 246, wherein the distance between the distal end of the switch plunger 242 and a base of the switch plunger 242 is referenced as a compressed plunger dimension 247.

The push switch 240 is provided in signal communication with the local lock engagement status monitoring apparatus 210 using any wired or wireless communication interface. The exemplary embodiment utilizes a first plunger contact electrical conductor 248 and a second plunger contact electrical conductor 249 to convey the state of the push switch 240 to the local lock engagement status monitoring apparatus 210. The push switch 240 commonly toggles between an electrically open state and an electrically closed state. The change in the electrical state can be monitored and utilized by the local lock engagement status monitoring apparatus 210 to determine and present the position of the door lock throw bolt 134.

The installation of the lock engagement status identification system 200 enables an installer to retrofit the present invention into almost any existing dead bolt styled door lock configuration.

Details of the local lock engagement status monitoring apparatus 210 are best presented in FIG. 5. The local lock engagement status monitoring apparatus 210 includes a status monitoring apparatus housing 212 defining a status monitoring apparatus housing interior 214. A housing wire port 216 is provided through the status monitoring apparatus housing 212, wherein the housing wire port 216 provides a pass through for the plunger contact electrical conductors 248, 249. The status monitoring apparatus housing 212 can be fabricated of any suitable material, with the preferred fabrication being of a molded plastic or formed sheet metal. The electrically functional components are assembled to a printed circuit board (PCB) 220, which is affixed within the status monitoring apparatus housing interior 214, using any mechanical fastener. The exemplary embodiment utilizes a plurality of spatially arranged PCB mounting hardware 239. Although the exemplary embodiment employs PCB mounting hardware 239 in the form of screws, it is understood that the printed circuit board (PCB) 220 can be affixed to the status monitoring apparatus housing interior 214 using any suitable mechanical fastener, including adhesive, bonding agents, snaps, rabbets, and the like.

The printed circuit board (PCB) 220 is fabricated using common PCB fabrication processes known by those skilled in the art. The PCB includes electrical pads (not shown) for electro-mechanically coupling electronic components thereto and electrical traces (not shown) providing signal and power communication between components to create a desired electronic circuit. A local microprocessor 222 and a local memory 224 are electro-mechanically assembled to the PCB using standard through hole or surface mount assembly (as shown) techniques. Power is provided to the circuit by including a power source interface. The exemplary power source interface includes a first power source contact 232 and a second power source contact 234. A portable power source 230 is inserted between the first power source contact 232 and second power source contact 234, providing power to the desired electronic circuit. It is understood that the portable power source 230 can be replaced by an external power source such as a transformer connected to an electrical outlet. The power would be transferred to the printed circuit board (PCB) 220 through the first power source contact 232 and second power source contact 234, wherein the first power source contact 232 and second power source contact 234 would be provided in a suitable form factor, such as a power connector. The desired electronic circuit would further comprise a voltage regulator 236 for managing and regulating power between the portable power source 230 and the balance of the desired electronic circuit. It is understood that the portable power source 230 can be rechargeable, enabling recharging from outside sources, such as a solar panel (not shown) that can be integrated into the status monitoring apparatus housing 212, mounting on an adjacent wall, and the like; a wind powered converter; a rainwater powered generator; and the like.

The status of the push switch 240 would be obtained through an electrical connection formed between the plunger contact electrical conductors 248, 249 and the printed circuit board (PCB) 220. The signal from the plunger contact electrical conductors 248, 249 is communicated to the local microprocessor 222 through the printed circuit board (PCB) 220. A set of instructions stored within either the local memory 224 or the local microprocessor 222 provides operational direction to the local microprocessor 222. The local memory 224 can additional store any of a variety of items, including: an electronic identification reference for the unit, an event history, additional conditional directions, wired or wireless communication protocols, and the like. A local engaged lock indicator 228 and local disengaged lock indicator 229 are electro-mechanically assembled to the printed circuit board (PCB) 220, wherein the local engaged lock indicator 228 and local disengaged lock indicator 229 provide a visual reference for the status of the door lock throw bolt 134. In a preferred embodiment, the local engaged lock indicator 228 would be emit a green colored light and the local disengaged lock indicator 229 would emit a red colored light. The preferred solution for the local engaged lock indicator 228 and local disengaged lock indicator 229 would be a Light Emitting Diode (LED), wherein the LED would emit a desired color to communicate the status of the door lock throw bolt 134 to an individual. It is understood that the local engaged lock indicator 228 and local disengaged lock indicator 229 can be combined into a single element, such as a multi-colored LED capable of emitting at least two different distinct colors depending upon the input signal. It is understood that the local engaged lock indicator 228 and local disengaged lock indicator 229 can be fabricated of any suitable visual and/or audible device, including incandescent colored bulbs, clear light emitting elements located behind a color tinted lens, a liquid crystal display (LCD), a speaker, a mechanical device that toggles between a locked and an unlocked identifier, and the like. The status can be continuously displayed or presented upon request by an individual.

A local transmitter or a local transmitter and receiver (transceiver) 226 can be integrated into the printed circuit board (PCB) 220, wherein the local transmitter and receiver 226 enable wireless communications between the local lock engagement status monitoring apparatus 210 and other devices. The local transmitter and receiver 226 can be used to communicate information to the master lock engagement status monitoring apparatus 250. The communication protocol can include an acknowledgement process, whereby the receiving device would transmit an acknowledgement signal back to the original transmitting device. The transmitting device would receive the acknowledgement signal and determine if the receiving device properly received the originally transmitted signal. The local transmitter and receiver 226 is exemplary of a transmitter or a transmitter and transceiver, commonly referred to as a transceiver. The wireless communication can employ any suitable protocol, including standard radio frequency transmission (RF), WiFi, Bluetooth, ZigBee, and the like. The transmissions can optionally be encrypted. Although the preferred embodiment for communicating between the local lock engagement status monitoring apparatus 210 and the master lock engagement status monitoring apparatus 250 is the employment of wireless technology, it is understood that the lock engagement status identification system 200 can utilized wired technology.

In operation, the local microprocessor 222 monitors the status of the signal provided by the push switch 240. When the local microprocessor 222 identifies a change in state of the push switch 240, the local microprocessor 222 operates in accordance with the set of instructions provided therein. The local microprocessor 222 would direct a change in display to reverse the status of each of the local engaged lock indicator 228 and the local disengaged lock indicator 229, thus ensuring the status of the local engaged lock indicator 228 and the local disengaged lock indicator 229 properly represents the state of the door lock throw bolt 134. Additionally, the local microprocessor 222 would direct the local transmitter and receiver 226 to transmit a signal to any pre-established receiving device, including the master lock engagement status monitoring apparatus 250 and any other associated device. The transmitted signal would include the electronic identification reference for the unit and the status of the monitored push switch 240.

Although the exemplary local lock engagement status monitoring apparatus 210 is configured in the illustration to monitor a single push switch 240, it is understood that the local lock engagement status monitoring apparatus 210 can be configured to monitor a plurality of push switches 240. In a multi-sensor monitor, the master transmitter and receiver 266 would include a method of conveying the status and associated sensor identity for one or more of the plurality of push switches 240.

Details of the master lock engagement status monitoring apparatus 250 are best presented in FIG. 5. The master lock engagement status monitoring apparatus 250 and the local lock engagement status monitoring apparatus 210 are constructed having a number of similar elements having similar function.

The master lock engagement status monitoring apparatus 250 includes a status monitoring apparatus housing 252 defining a status monitoring apparatus housing interior 254. The status monitoring apparatus housing 252 can be fabricated of any suitable material, with the preferred fabrication being of a molded plastic or formed sheet metal. The electrically functional components are assembled to a master printed circuit board (PCB) 260, which is affixed within the status monitoring apparatus housing interior 254, using any mechanical fastener. The exemplary embodiment utilizes a plurality of spatially arranged PCB mounting hardware 269. The attachment options for assembling the master printed circuit board (PCB) 260 to the status monitoring apparatus housing interior 254 are the same as those described for attaching the printed circuit board (PCB) 220 to the 214.

The master printed circuit board (PCB) 260 is fabricated in accordance with the same process described above for fabricating the printed circuit board (PCB) 220. A master microprocessor 262 and a master memory 264 are electro-mechanically assembled to the PCB using standard through hole or surface mount assembly (as shown) techniques. The functionality of the master microprocessor 262 and a master memory 264 would be similar in nature as the local memory 224 or the local microprocessor 222 described above. Power is provided to the circuit by including a power source interface. The exemplary power source interface includes a first power source contact 272 and a second power source contact 274. A portable power source 270 is inserted between the first power source contact 272 and second power source contact 274, providing power to the desired electronic circuit. Similarly, the portable power source 270 can be replaced by an external power source connected to an electrical outlet, wherein the power would be transferred to the master printed circuit board (PCB) 260 through the first power source contact 272 and second power source contact 274. The desired electronic circuit would further comprise a voltage regulator 276 for managing and regulating power between the portable power source 270 and the balance of the desired electronic circuit. Similar with the portable power source 230, the portable power source 270 can be rechargeable, enabling recharging from outside sources, such as a solar panel (not shown) that can be integrated into the status monitoring apparatus housing 252 or any other location as previously described.

The master lock engagement status monitoring apparatus 250 includes a series of lock status indicators 281, 282, 285, 286, 291, 292, 295, 296 to inform an individual of the status of a plurality of door lock throw bolts 134. The exemplary embodiment of the master lock engagement status monitoring apparatus 250 includes indicators for four (4) door lock throw bolts 134. The sets of indicators are presented in Table 1 provided below. It is noted, that the "n" reference is representative of any number of sets of indicators. Each of the sets of indicators (281,282), (285,286), (291,292), (295,296), is identified by an associated location reference 280, 284, 290, 294.

TABLE 1

Door Lock Status Indicator Element Reference Guide

| Location Reference | Engaged Lock Reference | Disengaged Lock Indicator (Green) | Indicator (Red) |
|---|---|---|---|
| A | 280 | 281 | 282 |
| B | 284 | 285 | 286 |
| C | 290 | 291 | 292 |
| n | 294 | 295 | 296 |

Each of the lock status indicators 281, 282, 285, 286, 291, 292, 295, 296 are electro-mechanically assembled to the master printed circuit board (PCB) 260, wherein each set of indicators (281,282), (285,286), (291,292), (295,296), provide a visual reference for the status of the respective door lock throw bolt 134 in accordance with the associated location reference 280, 284, 290, 294.

A master transmitter and receiver 266 are provided in signal communication with the circuit provided by the master printed circuit board (PCB) 260. The master transmitter and receiver 266 are similar to the local transmitter and receiver 226 described above and would be designed for wireless communication with the local lock engagement status monitoring apparatus 210 through the local transmitter and receiver 226. Additionally, a WiFi transceiver 268 can optionally provided in signal communication with the circuit provided by the master printed circuit board (PCB) 260, wherein the WiFi transceiver 268 provides a secondary wireless protocol.

The status of each of the at least one push switches 240 monitored by the local lock engagement status monitoring apparatus 210 would be transmitted by the local transmitter and receiver 226 and received by a master transmitter and receiver 266. The received signal would be transferred to the master microprocessor 262 or a similar device for decoding. The master microprocessor 262 would interpret the decoded signal and act in accordance with the set of instructions stored within either the master memory 264 or the master microprocessor 262.

It is understood that the lock status indicators 281, 282, 285, 286, 291, 292, 295, 296 can be fabricated of any suitable visual and/or audible device as previously described respective to the local lock indicators 228, 229.

The WiFi (or other externally communicating protocol) transceiver 268 provides a wireless protocol to communicate the status of the monitored door lock throw bolts 134 to individuals through the Internet or any Internet or connected device or other wireless device 299, such as a smartphone, a portable computing tablet, a personal data assistant (PDA), a pager, an Internet accessible computer, and the like. The WiFi transceiver 268 additionally enables an individual to submit a request to interrogate the master lock engagement status monitoring apparatus 250 to obtain a current status of each of the monitored door lock throw bolts 134 as currently known thereby. The request can additionally forward an interrogatory to each of the employed local lock engagement status monitoring apparatus 210, wherein the local lock engagement status monitoring apparatus 210 would determine the current status of the respective door lock throw bolt 134 as determined by the push switch 240 and return the status of the door lock throw bolt 134 to the master lock engagement status monitoring apparatus 250.

In operation, the master microprocessor 262 monitors the status of the signal received from the local transmitter and receiver 226 of the local lock engagement status monitoring apparatus 210. When the master microprocessor 262 receives a signal from the local transmitter and receiver 226 and identifies a change in state of one ore more of the monitored door lock throw bolts 134, the master microprocessor 262 operates in accordance with the set of instructions provided therein. The master microprocessor 262 initially determines which monitored location had a change in state of the respective door lock throw bolt 134. Subsequently, the master microprocessor 262 would direct the set of indicators (281,282), (285, 286), (291,292), (295,296) associated with the respective door lock throw bolt 134 or push switch 240 to toggle to properly represents the state of the respective door lock throw bolt 134 or push switch 240.

Additionally, the master microprocessor 262 can direct the WiFi transceiver 268 to transmit a signal to any pre-established receiving device 299, including a smart phone, an Internet website, a PDA, a computing tablet, and the like. Conversely, a remote device 299, such as the smart phone, the Internet website, the PDA, the computing tablet, and the like can submit a request for status to the master lock engagement status monitoring apparatus 250 through the WiFi transceiver 268.

Installation and operation of the lock engagement status identification system 200 is exemplified in the door lock engagement status indicator system installation and operation flow diagram 300 presenting in FIG. 6. Initially, the lock engagement status identification system 200 is installed in the structure 102 in accordance with an installation step 310. The installation step 130 includes assembling the push switch 240 to the striker box 160 and subsequently installing the striker box 160 into the wall stud 142. The installation is verified by toggling the door lock throw bolt 134 between the retracted door lock position 136 and the extended door lock position 138 by rotating the door lock thumb turn 130 and monitoring a change in state of the electrical condition between the plunger contact electrical conductors 248, 249, in accordance with a plunger switch operational verification step 312.

The local lock engagement status monitoring apparatus 210 is secured to a first wall 140 or other object adjacent to the door assembly 100. The master lock engagement status monitoring apparatus 250 is secured to a second wall 150 or other suitable object at a location advantages for a final assurance that all of the door lock throw bolts 134 of the door assemblies 100 are locked. Power is provided to each of the local lock engagement status monitoring apparatus 210 and master lock engagement status monitoring apparatus 250 by installing the portable power source 230 and portable power source 270 respectively or by coupling a transformer to the respective local lock engagement status monitoring apparatus 210 and master lock engagement status monitoring apparatus 250 and inserting the transformer into a wall outlet. The push switch 240 is placed in signal communication with the printed circuit board (PCB) 220 of the local lock engagement status monitoring apparatus 210 by connecting the plunger contact electrical conductors 248, 249 to the printed circuit board (PCB) 220, as referenced by a plunger switch wiring step 314. Once the system is installed, each connection is tested. One suggested method for testing the system would be to toggle each door lock throw bolt 134 between a retracted door lock position 136 and extended door lock position 138 and verify the display on each of the local lock engagement status monitoring apparatus 210 and master lock engagement status monitoring apparatus 250 properly reflects the condition of each of the door lock throw bolts 134.

Operation of the lock engagement status identification system 200 is driven by the status of the push switch 240. Each push switch 240 determines a status of a respective door lock throw bolt 134, more specifically, whether the door lock throw bolt 134 is in a retracted door lock position 136 or a extended door lock position 138. The movement of the door lock throw bolt 134 toggles an electrical condition of the push switch 240 between an open circuit and a closed circuit. The association of the electrical condition and the state of compression of the switch plunger 242 would be determined by the selected switch. The local microprocessor 222 of the local lock engagement status monitoring apparatus 210 determines the position of the door lock throw bolt 134 from the electrical condition provided by the push switch 240. The local microprocessor 222 directs power to illuminate the local lock indicator 228, 229 associated with the determined position of the door lock throw bolt 134, as indicated by a local status monitoring operational step 316. The local microprocessor 222 additionally directs the local transmitter and receiver 226 to transmit a signal including at least a portion of the following information: a location identification reference, a monitored item reference, and a monitored item condition to the master transmitter and receiver 266 of the master lock engagement status monitoring apparatus 250. The local transmitter and receiver 226 can optionally transmit a signal to other local lock engagement status monitoring apparatus 210 located throughout the structure.

Upon receipt of the signal from the local transmitter and receiver 226, the master transmitter and receiver 266 transfers the received signal, in either encoded or deciphered format, to the master microprocessor 262. The master microprocessor 262 determines the location of the signal, each specific push switch 240 associated with the data, the positional condition of each door lock throw bolt 134 based upon the state of the push switch 240, and any other suitable information. The master microprocessor 262 subsequently directs the associated lock status indicator(s) of the lock status indicators 281, 282, 285, 286, 291, 292, 295, 296 to illuminate, conveying the respective positional condition of each door lock throw bolt 134 in accordance with a master lock engagement status monitoring apparatus operational step 320.

The local lock engagement status monitoring apparatus 210 and/or the master lock engagement status monitoring apparatus 250 can optionally incorporate an audible alerting device, such as a speaker. The set of instructions providing operational directions to the local microprocessor 222 and/or the master microprocessor 262 can include a step of emitting an audible alert in conjunction with a change in status of one or more of the push switches 240.

In one embodiment, only the lock status indicator(s) associated with the push switch 240 indicating the respective door lock throw bolt 134 is in an extended door lock position 138 would illuminate to indicate that those respective door lock throw bolts 134 are in a locked condition. The preferred illumination would be green, which is commonly associated with an acceptable condition.

In another embodiment, only the lock status indicator(s) associated with the push switch 240 depicting the respective door lock throw bolt 134 is in a retracted door lock position 136 would illuminate to indicate that those respective door lock throw bolts 134 are in an unlocked condition. The preferred illumination would be red, which is commonly associated with an unacceptable condition.

In a third embodiment, the lock status indicator(s) associated with the push switch 240 depicting the respective door lock throw bolt 134 is in an extended door lock position 138 would illuminate to indicate that those respective door lock throw bolts 134 are in a locked condition and the lock status indicator(s) associated with the push switch 240 depicting the respective door lock throw bolt 134 is in a retracted door lock position 136 would illuminate to indicate that those respective door lock throw bolts 134 are in an unlocked condition. The lock status indicator(s) associated with the push switch 240 indicating the respective door lock throw bolts 134 are in an extended door lock position 138 would emit a green light. The lock status indicator(s) associated with the push switch 240 depicting the respective door lock throw bolts 134 are in a retracted door lock position 136 would emit a red light.

Each of these embodiments presents a solution that enables the individual to determine the status of each door lock throw bolt 134 of all of the monitored door assemblies 100 with a quick glance.

Although the communication link provided between each local lock engagement status monitoring apparatus 210 and the master lock engagement status monitoring apparatus 250 employs a wireless communication link, it is understood that the communication link provided between each local lock engagement status monitoring apparatus 210 and the master lock engagement status monitoring apparatus 250 can employ a hardwired communication link. The wired communication link can include common wires, Ethernet cabling, and the like. The WiFi transceiver 268 can be complimented or replaced by a wired Ethernet cable to an Internet connection.

The master lock engagement status monitoring apparatus 250 can be located internally to the structure 102 or externally to the structure 102. When mounted externally to the structure 102, the master lock engagement status monitoring apparatus 250 can optionally include a cover governing access thereto. The local lock engagement status monitoring apparatus 210 and/or master lock engagement status monitoring apparatus 250 can include a request feature, wherein the user would select the request feature to direct the local lock engagement status monitoring apparatus 210 and/or master lock engagement status monitoring apparatus 250 to display the status of the associated door lock throw bolts 134 for a predetermined period of time.

Although the exemplary embodiment is directed towards an installation monitoring a dead bolt lock configuration, it is understood that the application of the lock engagement status identification system 200 can include any sliding or rotating locking element, wherein the motion of the locking element between a locked configuration and an unlocked configuration.

In a low tier configuration, the local lock engagement status monitoring apparatus 210 can include a simple circuit comprising electrical power supplied to the circuit, an illuminating element (such as the local engaged lock indicator 228 or the local disengaged lock indicator 229), and a series of electrical conductors placing the illuminating element in series with the push switch 240. In this configuration, the push switch 240 toggles between a closed circuit and an open circuit based upon the position of the door lock throw bolt 134. The illuminating element would emit light when the push switch 240 is in a closed circuit configuration and the illuminating element would not emit light when the push switch 240 is in an open circuit configuration.

It is understood that the master lock engagement status monitoring apparatus 250 can be adapted to monitor one or more push switches 240 directly. Additionally, it is also understood that the local lock engagement status monitoring apparatus 210 can include a WiFi transceiver 268.

Optionally, in some embodiments, the lock engagement status identification system 200 can be configured to flash green when all of the doors 100 are locked. In some embodiments, a third light could be provided on the local lock engagement status monitoring apparatus 210 to indicate an "all locks secured" status.

While the above description uses a plunger switch 240 for determining whether the dead bolt 134 is in a locked status or an extended door lock position 138, other detection mechanisms an be employed to monitor and convey the axial position of the door lock throw bolt 134. For example, a magnetic or infrared signal could be used to determine if the door lock throw bolt 134 is in the striker box 160.

In addition, the lock engagement status identification system 200 can be designed in a multi-unit installation, where confirmation of all locks 134 being secured can be seen from a single location. Such a multi-unit installation may be especially useful where doors 100 are spaced apart or where doors 100 that are often less used may not be locked (having a retracted door lock position 136) and such unlocked condition may not be noticed for a period of time.

In yet another embodiment, the indicators can display one or more flashing lights. In some embodiments, the blinking (unlocked) signal indicating a separate door 100 is unlocked can be configured to flash a predetermined number of times (with a pause therebetween), where the number of flashes can indicate the specific door 100 that is unlocked.

In an alternative implementation, the lock engagement status identification system 200 can be adapted for use with any system where it may be helpful to easily detect when an item has been removed from a holder. For example, the system could be used for tools, valuables, automobile utilities, and the like.

The lock engagement status identification system 200 can be integrated into a home security system, where the push switch 240 not only determines the status of the door lock throw bolt 134, but may also be a trigger for initiating a security alarm process, such as starting a 30 second delay to disable the alarm.

Additional security can by provided by integrating an identification system into either the local lock engagement status monitoring apparatus 210 or the master lock engagement status monitoring apparatus 250. The identification system would obtain information associated with an individual unlocking the door 100. The information associated with the individual unlocking the door 100 can be stored and/or communicated to one or more predetermined recipients.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A door lock engagement status indicator system comprising:

a striker box comprising a throw bolt receptacle for receiving and engaging a throw bolt when said throw bolt is extended into a locked position;

a sensor affixed at a location wherein said sensor detects when said throw bolt is extended into a position within said throw bolt receptacle, said sensor being a mechanical switch mounted externally to a distal end wall of said throw bolt receptacle having an actuator extending into an interior space of said throw bolt receptacle, said mechanical switch being arranged to toggle between an open state and a closed state when said throw bolt sufficiently engages and disengages within said throw bolt receptacle; and a local lock engagement status monitoring apparatus comprising:

a local monitoring apparatus housing, a circuit in signal communication with said sensor, said circuit contained within an interior of said local monitoring apparatus housing, electrical power provided to said circuit, and an indicator to convey a status of at least one of:

when said throw bolt is extended into the position within said throw bolt receptacle, and when said throw bolt is retracted into a position clear of said throw bolt receptacle, wherein said indicator is provided in a manner that conveys said status of said throw bolt to an individual.

2. A door lock engagement status indicator system as recited in claim 1, wherein said mechanical switch is a switch plunger, wherein said plunger is oriented with a plunging axis of said plunger being substantially parallel to a direction of motion of said throw bolt.

3. A door lock engagement status indicator system as recited in claim 1, wherein said indicator comprises an illuminating element, wherein said illuminating element illuminates in accordance with one of:

when said throw bolt is extended into the position within said throw bolt receptacle, and when said throw bolt is retracted into the position clear of said throw bolt receptacle.

4. A door lock engagement status indicator system as recited in claim 1, wherein said indicator comprises an illuminating element, wherein said illuminating element illuminates in accordance with at least one of one of:

when said throw bolt is extended into the position within said throw bolt receptacle, said illuminating element emits a first light, and when said throw bolt is retracted into the position clear of said throw bolt receptacle, said illuminating element emits a second light, wherein said second light is different than said first light.

5. A door lock engagement status indicator system as recited in claim 1, wherein said indicator comprises an illuminating element, wherein said illuminating element illuminates in accordance with at least one of one of:

when said throw bolt is extended into the position within said throw bolt receptacle, said illuminating element emits a green light, and when said throw bolt is retracted into the position clear of said throw bolt receptacle, said illuminating element emits a red light.

6. A door lock engagement status indicator system as recited in claim 1, further comprising a transceiver in signal communication with said microprocessor, said transceiver being programmed to communicate with at least one receiving device, said receiving device being selected from a group comprising:

an Internet, an Internet connected device, a Smartphone, a portable computing tablet, a personal data assistant (PDA), and a pager.

7. A door lock engagement status indicator system comprising:

a striker box comprising a throw bolt receptacle for receiving and engaging a throw bolt when said throw bolt is extended into a locked position;

a sensor affixed at a location wherein said sensor detects when said throw bolt is extended into a position within said throw bolt receptacle;

at least one local lock engagement status monitoring apparatus, each of said at least one local lock engagement status monitoring apparatus comprising:

a local monitoring apparatus housing, a local circuit in signal communication with said sensor, said circuit contained within an interior of said local monitoring apparatus housing, a local microprocessor integrated into said local circuit wherein said local microprocessor operates in accordance with a local set of instructions, a local communication element integrated into said local circuit, wherein said local communication element comprises at least one of a local transmitter and a local transceiver, electrical power provided to said local circuit, and a local indicator to convey a status of at least one of:

when said throw bolt is extended into the position within said throw bolt receptacle, and when said throw bolt is retracted into a position clear of said throw bolt receptacle, wherein said local indicator is provided in a manner that conveys said status of said throw bolt to an individual; and a master lock engagement status monitoring apparatus comprising:

a master status monitoring apparatus housing, a master circuit, said master circuit contained within an interior of said master status monitoring apparatus housing, a master microprocessor integrated into said master circuit wherein said master microprocessor operates in accordance with a master set of instructions, a master communication element integrated into said master circuit, wherein said master communication element comprises at least one of a master receiver and a master transceiver, electrical power provided to said master circuit, at least one master indicator, wherein each of said at least one master indicator is associated with a respective one of said at least one local lock engagement status monitoring apparatus, wherein said at least one master indicator replicates a conveyance of said status conveyed by said one of said at least one local lock engagement status monitoring apparatus, and a master transceiver in signal communication with said master microprocessor, said master transceiver being programmed to communicate with at least one of receiving device, said receiving device being selected from a group comprising:

a Smartphone, a portable computing tablet, a personal data assistant (PDA), and a pager.

8. A door lock engagement status indicator system as recited in claim 7, wherein said sensor is a push switch.

9. A door lock engagement status indicator system as recited in claim 7, said sensor further comprising a switch plunger, wherein said sensor is carried by a distal end of said throw bolt receptacle and oriented with a plunging axis of said switch plunger being substantially parallel to a direction of motion of said throw bolt.

10. A door lock engagement status indicator system as recited in claim 7, wherein at least one of said local indicator and said master indicator comprises an illuminating element, wherein said illuminating element illuminates in accordance with one of:

when said throw bolt is extended into the position within said throw bolt receptacle, and when said throw bolt is retracted into the position clear of said throw bolt receptacle.

11. A door lock engagement status indicator system as recited in claim 7, wherein at least one of said local indicator and said master indicator comprises an illuminating element, wherein said illuminating element illuminates in accordance with at least one of one of:

when said throw bolt is extended into the position within said throw bolt receptacle, said illuminating element emits a first light, and when said throw bolt is retracted into the position clear of said throw bolt receptacle, said illuminating element emits a second light, wherein said second light is different than said first light.

12. A door lock engagement status indicator system as recited in claim 7, wherein at least one of said local indicator and said master indicator comprises an illuminating element, wherein said illuminating element illuminates in accordance with at least one of one of:

when said throw bolt is extended into the position within said throw bolt receptacle, said illuminating element emits a green light, and when said throw bolt is retracted into the position clear of said throw bolt receptacle, said illuminating element emits a red light.

13. A door lock engagement status indicator system as recited in claim 7, wherein at least one of said local communication element and said master communication element is in signal communication by one of:

a hard-wired communication interface, and a wireless communication interface.

14. A door lock engagement status indicator system as recited in claim 7, wherein said master transceiver is preprogrammed to directly communicate with said at least one receiving device.

15. A door lock engagement status indicator system as recited in claim 7, the master lock engagement status monitoring apparatus comprising an all doors locked indicator mode, wherein in a condition where all doors are locked, all of the at least one master indicator flash indicating an all locked condition.

16. A door lock engagement status indicator system comprising:

a striker box comprising a throw bolt receptacle for receiving and engaging a throw bolt when said throw bolt is extended into a locked position;

a sensor affixed at a location wherein said sensor detects when said throw bolt is extended into a position within said throw bolt receptacle;

at least one local lock engagement status monitoring apparatus, each of said at least one local lock engagement status monitoring apparatus comprising:

a local monitoring apparatus housing, a local circuit in signal communication with said sensor, said circuit contained within an interior of said local monitoring apparatus housing, a local microprocessor integrated into said local circuit wherein said local microprocessor operates in accordance with a local set of instructions, a local communication element integrated into said local circuit, wherein said local communication element comprises at least one of a local transmitter and a local transceiver, electrical power provided to said local circuit, and a local indicator configuration comprising at least one illuminating element to convey a status of at least one of:

when said throw bolt is extended into the position within said throw bolt receptacle, and when said throw bolt is retracted into a position clear of said throw bolt receptacle, wherein said local indicator is provided in a manner that conveys said status of said throw bolt to an individual;

a master lock engagement status monitoring apparatus comprising:

a master status monitoring apparatus housing, a master circuit, said master circuit contained within an interior of said master status monitoring apparatus housing, a master microprocessor integrated into said master circuit wherein said master microprocessor operates in accordance with a master set of instructions, a master communication element integrated into said master circuit, wherein said master communication element comprises at least one of a master receiver and a master transceiver, electrical power provided to said master circuit, at least one master indicator, wherein each of said at least one master indicator is associated with a respective one of said at least one local lock engagement status monitoring apparatus, wherein said at least one master indicator replicates a conveyance of said status conveyed by said one of said at least one local lock engagement status monitoring apparatus, and a master transceiver in signal communication with said master microprocessor, said master transceiver being programmed to communicate with at least one of receiving device, said receiving device being selected from a group comprising:

an Internet, an Internet connected device, a Smartphone, a portable computing tablet, a personal data assistant (PDA), and a pager, wherein bi-directional communication enables:

said master transceiver to communicate said change in status of said monitored door lock throw bolts to at least one individual, and at least one individual to submit a request to interrogate said master lock engagement status monitoring apparatus to obtain said current status of each of said monitored door lock throw bolts as currently known thereby.

17. A door lock engagement status indicator system as recited in claim 16, wherein said sensor is a push switch.

18. A door lock engagement status indicator system as recited in claim 16, said sensor further comprising a switch plunger, wherein said sensor is carried by a distal end of said throw bolt receptacle and oriented with a plunging axis of said switch plunger being substantially parallel to a direction of motion of said throw bolt.

19. A door lock engagement status indicator system as recited in claim 16, wherein said at least one illuminating element illuminates in accordance with at least one of one of:

when said throw bolt is extended into the position within said throw bolt receptacle, said illuminating element emits a first light, and when said throw bolt is retracted into the position clear of said throw bolt receptacle, said illuminating element emits a second light, wherein said second light is different than said first light.

20. A door lock engagement status indicator system as recited in claim 16, wherein said at least one illuminating element illuminates in accordance with at least one of one of:

when said throw bolt is extended into the position within said throw bolt receptacle, said illuminating element emits a green light, and when said throw bolt is retracted into the position clear of said throw bolt receptacle, said illuminating element emits a red light.

21. A door lock engagement status indicator system as recited in claim 16, wherein at least one of said local communication element and said master communication element is in signal communication by one of:

a hard-wired communication interface, and a wireless communication interface.

22. A door lock engagement status indicator system as recited in claim 16, wherein said master transceiver is preprogrammed to directly communicate with said at least one receiving device.

23. A door lock engagement status indicator system as recited in claim 16, the master lock engagement status monitoring apparatus comprising an all doors locked indicator mode, wherein in a condition where all doors are locked, all of the at least one master indicator flash indicating an all locked condition.

* * * * *